US006108022A

United States Patent [19]

Landman et al.

[11] Patent Number: 6,108,022

[45] Date of Patent: Aug. 22, 2000

[54] METHOD FOR PRODUCING IDENTIFICATION DOCUMENTS AND DOCUMENTS PRODUCED BY IT

[75] Inventors: Avi Landman, Kiriat Haim; Jacob Hassan, Tel-Aviv; Eli Rozen, Herzelia, all of Israel

[73] Assignee: Supercom Ltd., Kfar-Saba, Israel

[21] Appl. No.: 08/930,946

[22] PCT Filed: Apr. 12, 1996

[86] PCT No.: PCT/US96/05084

§ 371 Date: Dec. 18, 1997

§ 102(e) Date: Dec. 18, 1997

[87] PCT Pub. No.: WO96/32256

PCT Pub. Date: Oct. 17, 1996

[30] Foreign Application Priority Data

| | | | |
|---|---|---|---|
| Apr. 13, 1995 | [IL] | Israel | 113358 |
| Mar. 14, 1996 | [IL] | Israel | 117484 |

[51] Int. Cl.[7] ..... B41J 2/435; B41J 2/39

[52] U.S. Cl. ..... 347/228; 347/140; 347/141; 347/212; 399/336; 399/342

[58] Field of Search ..... 347/212, 213, 347/262, 264, 228, 140, 141; 156/247; 283/67; 281/15.1; 399/223, 330, 336, 341, 342

[56] References Cited

U.S. PATENT DOCUMENTS

| | | | |
|---|---|---|---|
| Re. 32,056 | 12/1985 | Granzow et al. | 141/1 |
| 3,013,878 | 12/1961 | Dessauer | 430/126 |

(List continued on next page.)

FOREIGN PATENT DOCUMENTS

| | | |
|---|---|---|
| 195104 | 9/1986 | European Pat. Off. . |
| 253338 | 7/1987 | European Pat. Off. . |
| 232709 | 8/1987 | European Pat. Off. . |
| 0412520 | 2/1991 | European Pat. Off. . |
| 0457579 | 11/1991 | European Pat. Off. . |
| 553508 | 11/1992 | European Pat. Off. . |
| 0531888 | 3/1993 | European Pat. Off. . |
| 29505969 | 6/1995 | Germany . |
| 291769 | 11/1996 | Taiwan . |

(List continued on next page.)

OTHER PUBLICATIONS

Grant & Hackh's Chemical Dictionary, 5$^{th}$. ed. Roger Grant and Claire Grant. p. 531, McGraw–Hill, 1987.

*Primary Examiner*—N. Le
*Assistant Examiner*—Hai C. Pham
*Attorney, Agent, or Firm*—Pitney, Hardin, Kipp & Szuch, LLP

[57] ABSTRACT

A method for making documents, in particular identifying documents, such as passports and identifying cards, comprises the steps of providing a set of signals, particularly digital signals, defining an image to be printed on the document; providing a temporary substrate; depositing on the temporary substrate coloring matters, whereby to produce thereon the image, by the conventional laser printing method; provisionally setting the image; juxtaposing the temporary substrate with its face carrying the image in contact with the rear face of a transparent substrate; transferring the image from the temporary substrate to the transparent substrate, whereby the image is applied to the transparent substrate rear face and is visible through the transparent substrate from the front face thereof; removing the temporary substrate; and binding the transparent substrate, by lamination, to other components of the document to be produced. When the document is in booklet form, the binding of the transparent substrate effected by juxtaposing it to a final substrate that is part of the booklet and laminating it in contact with the final substrate. When the document is a card, the method also comprises providing a card blank which comprises a front and back leaf, one or both of which are transparent, and laminating the leaves, whereby to produce a card, wherein at least one printed image is visible from its front face.

37 Claims, 15 Drawing Sheets

U.S. PATENT DOCUMENTS

| | | | |
|---|---|---|---|
| 3,068,140 | 12/1962 | Biddle | 156/227 |
| 3,203,877 | 8/1965 | Facquet et al. | 205/271 |
| 3,444,732 | 5/1969 | Robbins et al. | 73/150 A |
| 3,811,828 | 5/1974 | Ohta et al. | 432/227 |
| 3,826,701 | 7/1974 | Miller | 156/359 |
| 3,925,139 | 12/1975 | Simmons | 156/358 |
| 4,243,458 | 1/1981 | Giulie | 156/247 |
| 4,389,438 | 6/1983 | Ohtsuki et al. | 428/34.2 |
| 4,560,426 | 12/1985 | Moraw et al. | 156/64 |
| 4,687,526 | 8/1987 | Wilfert | 156/64 |
| 4,923,556 | 5/1990 | Kettelhoit et al. | 156/498 |
| 4,928,996 | 5/1990 | Oshikoshi et al. | 283/109 |
| 4,978,146 | 12/1990 | Warther et al. | 283/81 |
| 4,992,833 | 2/1991 | Derimiggio | 399/308 |
| 5,058,926 | 10/1991 | Drower | 283/109 |
| 5,121,343 | 6/1992 | Faris | 395/111 |
| 5,211,424 | 5/1993 | Bliss | 281/15.1 |
| 5,261,987 | 11/1993 | Luening et al. | 156/234 |
| 5,306,381 | 4/1994 | Nakazawa et al. | 399/69 |
| 5,320,387 | 6/1994 | Carlson | 283/75 |
| 5,380,044 | 1/1995 | Aitkens et al. | 283/67 |
| 5,532,724 | 7/1996 | Inagaki et al. | 347/213 |
| 5,568,170 | 10/1996 | Hirano et al. | 347/51 |
| 5,973,710 | 10/1999 | Landman et al. | 347/140 |

FOREIGN PATENT DOCUMENTS

| | | |
|---|---|---|
| 2267058 | 5/1992 | United Kingdom . |
| 2273466 | 6/1994 | United Kingdom . |
| 2281535 | 3/1995 | United Kingdom . |
| 90/05640 | 11/1989 | WIPO . |
| 93/25391 | 6/1993 | WIPO . |
| 94/03333 | 7/1993 | WIPO . |
| WO9312940 | 7/1993 | WIPO . |
| WO9506567 | 3/1995 | WIPO . |

METHOD FOR PRODUCING IDENTIFICATION DOCUMENTS AND DOCUMENTS PRODUCED BY IT

FIELD OF THE INVENTION

This invention relates to a laser printing method and apparatus for producing documents bearing printed graphic matter and textual matter, generally including identifying photographs, comprising documents bound in booklet form, particularly passports and the like, and other identification documents, such as identity cards, passes and the like, and to the documents obtained by said method.

BACKGROUND OF THE INVENTION

In this application, the terms "substrate" or "printing substrate", without further specification, include any substrate on which printing is effected, regardless of its form and composition, be it e.g. uncoated or coated paper, plastic or any other sheet material, or a page of a booklet or other bound object intended to carry printing on pages or other parts thereof. The terms "picture" or "image" or "subject matter", as used herein, synonimously indicate any kind of printable or printed subject matter, and therefore comprise, among other things, pictures representing persons or objects, portraits, photographs, letters, words, signs, signatures, data, and any figures or images or graphic symbols that may be carried by a substrate of any kind. In many cases to which this invention is applied, the picture comprises a portrait of the owner of a document and words, numbers and the like, that contain information relevant to the identity of said owner and to the character, validity period, and other features of the document itself.

Graphic matter printed on passports, identifying cards and like documents, generally includes identifying photographs, particularly color photographs, accompanied by identifying data. For this purpose, the laser printing process and laser printing machines are widely used.

Basically, the laser printing process comprises, as a first step, defining the subject matter to be printed in the form of an array of signals that can be used to control the printing machine. A common way of doing this consists in capturing the subject matter to be printed and registering the results of the capturing in a processor's memory, in the form of an array of digital signals. Said signals control the emission of laser rays from a laser source. The laser beams impinge on a cylinder in a pattern controlled by the said signals and electrostatically charge the surface of said metal cylinder at selectively predetermined spots. The selectively electrostatically charged cylinder passes in the vicinity of a reservoir of coloring matter in powder form. The coloring matter particles are attracted to the aforesaid selectively charged spots of said cylinder and form thereon the desired pattern. A print substrate is then passed into contact with the metal cylinder and the pattern formed by the color particles is deposited thereon. This operation is repeated for each color if a multicolor print is desired, usually four times to provide the basic colors magenta, cyan and yellow plus black (black will hereinafter be considered to be a color), to produce a complete color image. At this stage a colored image has been formed on the print substrate. In order to stabilize the image, the print substrate is passed between heated rollers, which fix or set the print so that it is permanent and stable.

This process is quite effective for a number of applications, but it encounters difficulties, hitherto unsolved, when it is necessary to print on a substrate that is not in the form of a free sheet, but is in bound e.g. in the form of a booklet or a pouch, typically a passport or similar bound document. It would be highly desirable to print on a passport or like document, after it has already been bound in booklet form, the passport holder's photograph, signature, and/or other printed information. However, this is not possible with conventional color laser printing techniques. Other difficulties would arise, should the print substrate have a surface which is not absorbent with respect to the colors: the coloring matter is then partly if not totally transferred from the print substrate to the heat-setting rollers.

Pending U.S. patent application Ser. No. 08/398,642, filed on Mar. 3, 1995, describes and claims a method for printing on substrates in booklet form, which comprises the following steps:

1—providing a set of instructions, which reverses the original subject matter to be printed to define a reversed subject matter file;

2—providing a temporary substrate, the surface of which is substantially non-absorbent and non-adhesive for the coloring matters to be used for the printing;

3—depositing on said temporary substrate coloring matters, whereby to form thereon said reversed subject matter, by the appropriate steps of the conventional laser printing method;

4—provisionally setting said reversed subject matter by radiant heat;

5—juxtaposing said temporary substrate face-to-face with the final printing substrate;

6—transferring the reversed subject matter from said temporary to said final substrate, whereby said reversed subject matter is reversed and reproduces said original subject matter on said final substrate; and 7—setting said reproduced original subject matter on said final substrate by the application of pressure and optionally heat.

Said process, however, is difficult to carry out and does not provide the desired printing quality, whenever the final substrate does not have a surface that is fully suitable for receiving the reproduced original subject matter and permitting it to be set thereon. This occurs relatively often when said substrate is part of a booklet, particularly a passport, and more particularly when the print is to be effected on the inside of a booklet or passport cover. The cover must have a certain stiffness and is made of a material which possesses it, and, even it is covered by a sheet of paper adhesively connected thereto, its surface irregularities render it unsuitable as substrate for the aforesaid or other known printing methods. On the other hand, printing on the inside of the cover may be preferable or even necessary when the inner sheets are too light or otherwise unsuitable for printing pictures thereon.

On the other hand, identity cards, passes, and the like are prepared, according to the art, by providing a front and/or a back sheet, the front sheet at least being transparent, inserting between them a third sheet, bearing the desired printed matter—photographs, words, numbers and the like—joining the front and back sheet together by lamination, thus sealing the printed sheet therebetween, and trimming the resulting laminated card to the desired contour. This method of production has several drawbacks. Firstly, the final lamination requires that the printed sheet be smaller than the final card, in order to leave a sufficiently wide margin on all sides of the card, along which the front and back sheets are laminated together. But, as a consequence, either the card is unnecessarily large or the printed area is unnecessarily limited. Secondly, said method requires a final trimming, since it is impossible to assemble with sufficient precision the sheets to be laminated. Finally, the presence of an intermediate sheet between the front and back sheets makes it possible, in many cases, to disconnect the said layers sufficiently to reach said intermediate sheet and alter or counterfeit the printing it bears.

It is a purpose of this invention to overcome the drawbacks of prior art methods and efficiently and economically to produce documents, in particular identification documents both in bound and in card form, such as passports and the like or identity cards and the like.

It is another purpose of this invention to make it possible satisfactorily to print subject matter, including multicolor subject matter such as data and photographs, on substrates that are part of booklets, particularly of passports and pouches, and the like.

It is a further purpose of this invention to provide a method for printing subject matter, including identifying data and photographs and the like, on the inside of the covers or on any other page of bound substrates, such as passports and the like.

It is a still further purpose of this invention to provide an apparatus for achieving the aforesaid results, which apparatus is simple and not expensive to make nor difficult to use.

It is a still further purpose of this invention to provide a new and improved method for the production of identity cards, passes and the like, that is free from the drawbacks of prior art methods.

It is a still further purpose of this invention to provide such a method that does not require a trimming operation.

It is a still further purpose of this invention to provide such a method which permits to fill almost the entire surface of the card with information.

It is a still further purpose of this invention to provide an identifying document, in particular an ID card, that cannot be separated into component layers, for purposes of altering or counterfeiting its content.

It is a still further purpose of this invention to provide such a document, in particular an ID card, in which practically the entire surface bears printed matter, such as photographs, words, and other information.

It is a still further purpose of this invention to provide an identifying card or the like that is completely transparent, and therefore is difficult to counterfeit.

It is a still further purpose to achieve the aforesaid purposes by applying a modified laser printing method.

Other purposes and advantages of this invention will appear as the description proceeds.

SUMMARY OF THE INVENTION

The method for making documents, according to the invention, comprises the following steps:

a—providing a set of signals—particularly digital signals, such as a computer file, a frame grabber, a memory buffer or the like—defining subject matter to be printed on the document (which will be synonimously called hereinafter "the picture" or "the image" or "the original picture or image" or "image file");

b—providing a temporary or intermediate substrate, preferably a substrate the surface of which is substantially non-absorbent and non-adhesive for the coloring matters to be used for the printing or at least is considerably less adhesive and/or absorbent for said coloring matters than that of the transparent substrate, mentioned hereinafter;

c—depositing on said temporary substrate coloring matters, whereby to produce thereon said original image, by the appropriate steps of the conventional laser printing method;

d—provisionally setting said image, preferably without the application of pressure, and more preferably by radiant heat or dielectric or microwave heating;

e—juxtaposing said temporary substrate with its face carrying said image in contact with the rear face of a transparent substrate;

f—transferring said image from said temporary substrate to said transparent substrate, whereby the said image is applied to said transparent substrate rear face and is visible, in normal form, through said transparent substrate from the front face thereof (and would be seen as reversed from the rear face thereof);

g—removing said temporary substrate; and h—binding said transparent substrate to other components of the document to be produced.

By "front face" of a transparent substrate is meant herein the face of the substrate from which any image carried by it is intended to be viewed, and by "rear face" is meant the opposite face. These terms, therefore, are independent of the way in which the substrate is connected to other components of the document.

If the document is in booklet form, such as a passport, the binding of the transparent substrate to other components of the documents is effected by:

juxtaposing said transparent substrate to the final substrate that is intended to carry the image, with the rear face of said transparent substrate in contact with the front face of said final substrate; and 8—hot and/or cold laminating said transparent substrate in contact with said final substrate, permanently to bond them, whereby said image becomes enclosed in the laminate and visible through said transparent substrate as if printed on said final substrate.

If the identifying document is a card, e.g. an identity card, driving license and the like, the method of the invention comprises a preliminary step of:

providing a card blank (pouch) which comprises a front and a back sheet or leaf having the desired shape and dimensions, at least the front leaf being transparent and the back leaf being transparent or opaque, the two leaves being connected in fixed positioned relationship, preferably by being joined along a very narrow strip on one side by lamination or adhesively or in any other convenient way.

Thereafter steps 1 to 7, as hereinbefore defined, are carried out, the transparent substrate being, in this case, the front leaf of the card blank, or the back leaf, if it is transparent.

Finally, the binding of the transparent substrate to other components of the document is effected by:

laminating said front and back leaves, whereby to produce a card, wherein said image is visible from its front face.

In a variant of the invention, an opaque core is provided in the card blank, in addition to the front and back leaves, which are both transparent. In that case, a second temporary substrate may be prepared as hereinbefore described, said second temporary substrate carrying a second image (which may be equal to or different from the image applied to said rear face of said front leaf), and said second image may be transferred to the rear face of said transparent back leaf, whereby it will be visible, in normal form, through said transparent back leaf from the front face thereof. In this case, the transparent back leaf will also be a transparent substrate, in the sense in which this expression is used herein. As will appear hereinafter, the first mentioned temporary substrate, carrying the image to be transferred to the rear face of the transparent front leaf, and the second temporary substrate may be physically joined and may be prepared concurrently.

The above definitions of the terms "front face" and "rear face", when applied to a card, mean that "front face" is the surface of a front or back leaf, or of the whole card, that faces a person who holds the card in such a way as to look at the main information borne by it, e.g. to the photograph and identifying data of the card holder, and "rear face" is the surface of a front or back leaf, or of the whole card, that is opposite to its front face. In other words, front face is the face on which or through which the main information is seen and rear face is the opposite face. Therefore, in the case of a card having a transparent front and back leaves, the front faces of said leaves are the outer surfaces of the finished card.

In another variant of the invention, in which an opaque core is provided in the card blank, said core is pre-printed on one or on both of its faces. The pre-printed matter on the core front face (if any) will be seen as blending with the printed matter transferred from a temporary substrate to the rear face of the front leaf of the card blank, and the printed matter on the core rear face (if any) will be seen as blending with the printed matter transferred from a temporary substrate to the rear face of the back leaf of the card blank (if any). If the core is not pre-printed on its front face, it will provide a background to the printed matter transferred to the rear face of the front leaf, and if it is not pre-printed on its rear face it will provide a background to the printed matter (if any) transferred to the rear face of the back leaf.

The setting of the image occurs to a substantial degree as a consequence of the transfer from the temporary to the transparent substrate and is preferably completed in the lamination of the transparent substrate to other components of the document. When the document is in bound form, the transparent substrate may be part of the bound structure, of which the final substrate is a part or a separate sheet. Its rear face is, as stated above, the face that is intended to be juxtaposed and bound to the final substrate; its front face is the opposite face, which will remain free and from which the image will be visible. If the document is in the form of a card, the front leaf will be a transparent substrate, and, in some embodiments, the back leaf will also be a transparent substrate; and the outer faces of the card from which the images are visible, will be the front faces of said substrates. The front face is preferably smooth and shiny, while the rear face preferably has a non-smooth finish that facilitates the adhesion and the absorption of the coloring matter of the print, and/or may be covered with a thin layer of adhesive matter. It may be made, for example, of polyester, e.g. polyester sheet, such as DuPont's Mylar™ and have a thickness from 10 to 70$\mu$.

An intermediate or temporary substrate should have such a surface, that it is possible to transfer from it to a transparent substrate coloring matter that has been provisionally set without the application of pressure, e.g. by radiant heat. Such transfer is effected by the application of pressure, and, possibly, moderate heat, under conditions that are sufficiently mild not to damage the transparent substrate. Setting of the print to a significant degree, though not necessarily complete, occurs in the transfer operation. The temporary substrate should have a smooth surface, non-absorbent for the colors used in the laser printing. Silicone coated papers have such surfaces. A preferred example is paper SBL 42 MGA SILOX 8L/0.

The final setting of the images may be carried out by the application of pressure and optionally heat during the laminating operation itself, viz. be a consequence of the laminating conditions. However, since the image is protected, once the lamination has occurred, by a transparent sheet, the setting conditions may be mild. An adhesive layer may also be applied to a transparent substrate, over the whole rear face thereof, to facilitate the transfer of the image to said substrate. In this case the setting conditions may be particularly mild. The presence of an adhesive layer on the rear face of a transparent substrate, before transferring the picture to it, does not substantially influence the lamination, since such a layer will be extensively covered by the coloring matter of the picture.

Laminating temperatures are influenced by the nature of the transparent substrate and the presence or absence of adhesive between the transparent and the final substrates, and may vary in general from 40° to 180° C.

In the case of the document in the form of a booklet, the final substrate may be a page of the booklet, but will be, in many cases to which this invention is applied, the inside of the cover of a passport or like identification document.

In the case of the document in the form of a card having an opaque core, in addition to the front and back leaves, which are both transparent, a second temporary substrate may be as hereinbefore described, said second temporary substrate carrying a second image (which may be equal to or different from the image applied to said rear face of said front leaf), and said second image may be transferred to the rear face of said transparent back leaf, whereby it will be visible, in normal form, through said transparent back leaf from the front face thereof. As will appear hereinafter, the first mentioned temporary substrate, carrying the image to be transferred to the rear face of the transparent front leaf, and the second temporary substrate may be physically joined and may be prepared concurrently.

In another variant of the invention, when a card is prepared, the front and the back leaf are transparent, they may be bound in a booklet, such as a passport, so that the card, which results from transferring print to the front leaf and laminating the front and the back leaf together, forms part of the booklet, and the matter printed thereon can be seen against the background of the following opaque leaf of the booklet. However, such cards having transparent front and back leaves need not be so bound and may be used as independent cards, as any other cards according to this invention.

The apparatus according to the invention comprises two components, which may and often will not be structurally connected. The first component is a laser printer, which is characterized in that the print substrate used (which, when the method of the invention is applied, is a temporary substrate), carrying the image, is passed through a heat-setting section in which the printout is provisionally heat-set without the application of pressure, preferably by the application of radiant heat or microwave heating, but otherwise may be any type of known laser printer. The second component is an apparatus for carrying out two operations: transferring the image from the temporary substrate onto the transparent substrate; and laminating this latter to the final substrate. Both are carried out by applying pressure and, if required, heat, to the juxtaposed substrates, by means of rollers or pressure plates. Since temperature and possibly pressure conditions will be different in the two operations, a separate apparatus unit will conveniently be used for each of them. Said second component, however, can be dispensed with, since the operations it performs can be carried out manually.

Booklets and documents, such as passports and other documents, such as identifying cards, are part of the invention.

The identifying card according to the invention is characterized in that it comprises at least a front and a back leaf, laminated together, the front leaf having an image carried by its rear face and visible through said front leaf from its front face. In a variant of the invention, the document also comprises an opaque core sandwiched between said front and back leaves and laminated therewith. In another variant of the invention, said core is pre-printed on one or both of its faces. In a further variant of the invention, the rear face of the back leaf of the document also bears a printed image, visible from the front face of said back leaf.

DETAILED DESCRIPTION OF PREFERRED EMBODIMENT

Figure 1:
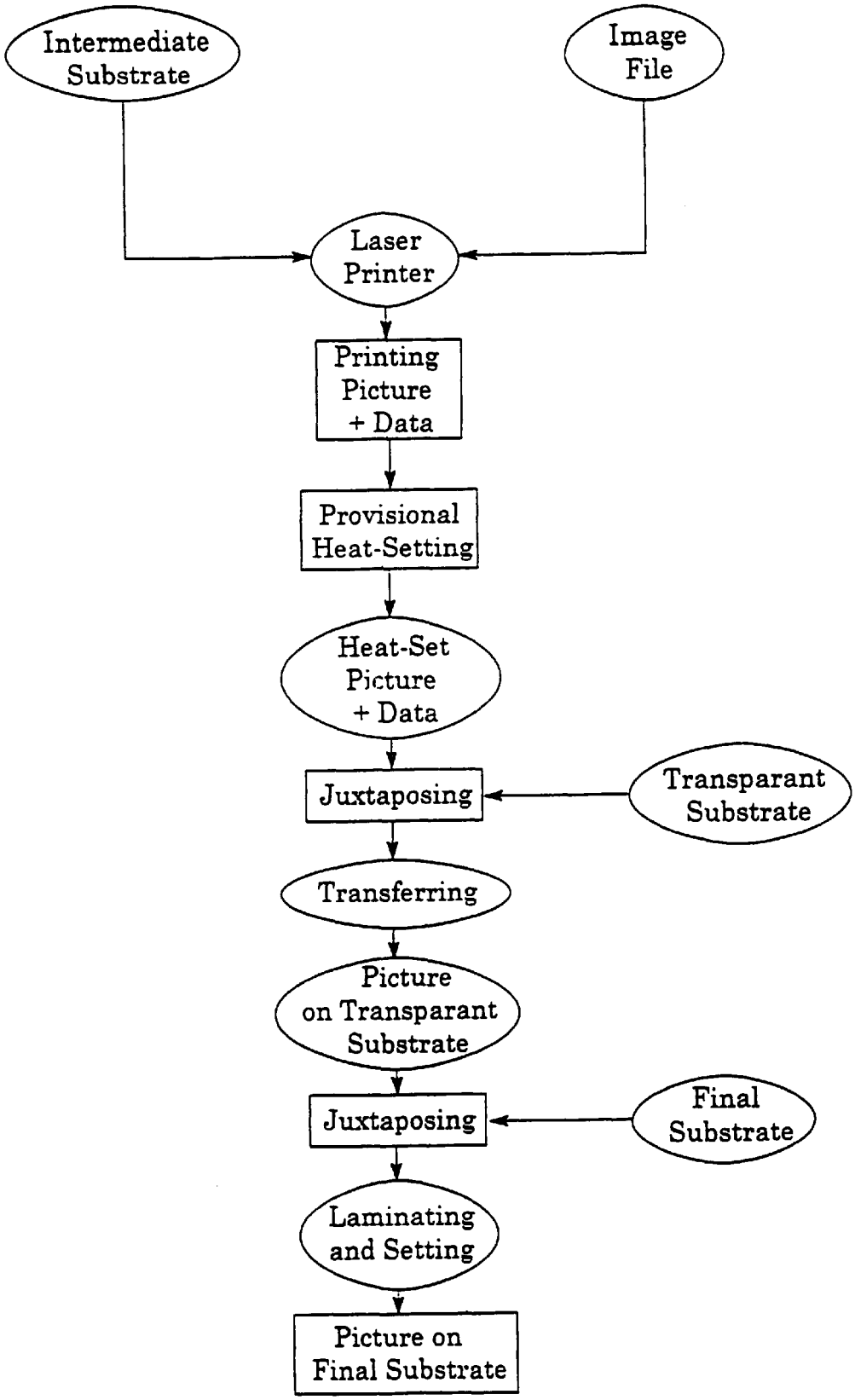
FIG. 1 is a flow diagram schematizing a method according to an embodiment of the invention, wherein the document to be made is in the form of a booklet.

FIG. 1 is a flow diagram representing the method of the invention applied to the preparation of a document in booklet form. As seen therein, the image file, no matter how obtained (e.g. from scanning, from composing pictures with data, from a frame grabber, from a video camera or from a buffer memory) is registered in the memory of a general purpose or special computer which controls the laser printer.

An intermediate substrate is fed to the laser printer. This intermediate substrate must have a surface which is considerably less adhesive and/or absorbent to the colors used in the printing than the transparent substrate, as hereinbefore set forth. An example of intermediate substrates are papers coated with silicones or Teflon, such as are used for applying to them, for storage and transport, self-adhesive stickers, but not limited, to which papers the silicone coating imparts a smooth, non-adhesive-retaining surface to facilitate the removal of the stickers. The choice of the intermediate substrate is influenced by the transparent substrate to be used, since it is required that the capability of the intermediate substrate of capturing and/or retaining the printing colors to be used be considerably less than that of the rear face of the transparent substrate.

The intermediate substrate is fed to the laser printer and the image file is printed on the said substrate with various colors in such patterns as to form an image in the conventional way in which this operation is carried out in laser printers. Any type of laser printer can be used for this purpose. After the formation of the image, however, the setting is not carried out as in a conventional laser printer, but is carried out by radiant or IR or microwave heating, thus producing, without the application of pressure, a provisionally heat-set image.

Said provisional setting is only partial and not as complete as the setting normally carried out in laser printers, but is sufficient for the image to be stable enough to permit carrying out the following steps of the process of the invention. Before the provisional setting, on the other hand, the image is quite liable and would not stand the manipulations required by the invention.

The intermediate substrate, carrying the provisionally heat-set image, is juxtaposed to the rear face of the transparent substrate. This operation, as has been said, does not occur in the laser printer but it may be a completely manual operation or it may occur in a different part of the apparatus according to the invention, which can be completely separated from the structural viewpoint from the laser printer, or can be in some way combined with it. At this stage the image is located between the intermediate substrate and the rear face of the transparent substrate—it is sandwiched, it may be said, therebetween. To the juxtaposed intermediate and transparent substrates, pressure and, if required, moderate heat, such as will not damage the transparent substrate, are applied to transfer the image to this latter, in which operation the original image becomes visible from the front face of the transparent substrate. In this operation, the transparent substrate may be bound in the booklet, e.g. the passport, to which the invention is applied, of it may be a separate sheet. In both cases pressure and, if required, heat, can be applied to the juxtaposed substrates by means of pressure plates, rollers or other means. Once the image has been transferred to the transparent substrate, the temporary substrate is removed leaving the image on the rear face of the transparent substrate. Finally, the transparent substrate is juxtaposed with its rear face to the final substrate, and pressure and, optionally, heat is applied to laminate the transparent substrate to the final substrate, the image being enclosed between the two and visible from the front face of the transparent substrate.

Figure 2:
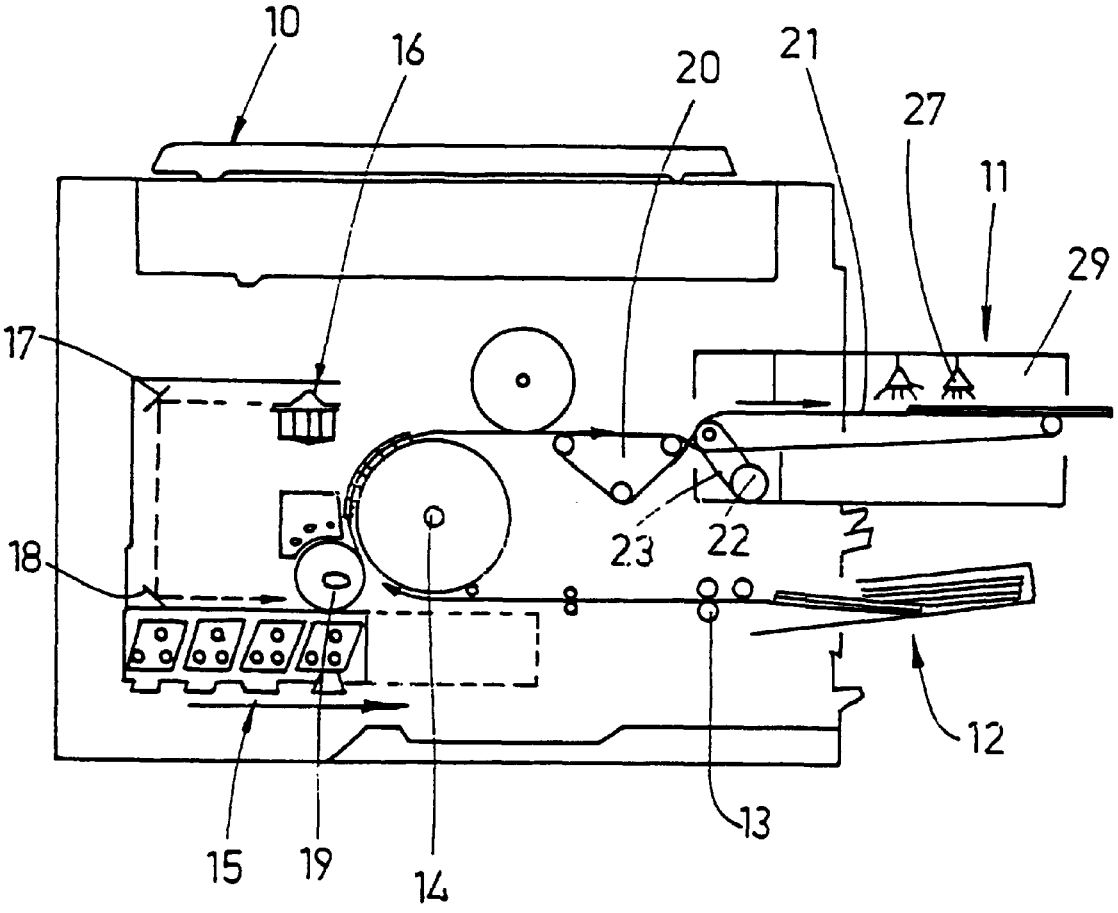
FIG. 2 is a schematic cross-section of the first component of an apparatus according to an embodiment of the invention.

FIG. 2 schematically illustrates a conventional laser printer modified according to the invention. The laser printer is generally indicated at 10 and may be any conventional laser printer except for the heat-setting portion, which is indicated at 11. The conventional part of the laser printer structure is well known to persons skilled in the art. It comprises a feed section 12 from which sheets are fed by means of a group of rollers 13 to a drum 14. Four containers are indicated in the drawing, since it is assumed that the printing is multicolor printing and is carried out in the three basic colors, magenta, cyan and yellow, plus black. Conventional means are provided for shifting containers 15 so that each of them may come into contact with drum 14 at the appropriate moments and transfer its coloring matter onto said drum. A laser source, not shown, directs a laser beam, controlled by digital control means, onto an octagonal mirror 16, from which the beam is deviated according to a program and successively reflected by mirrors 17 and 18 to impinge on a drum 19, according to the patterns determined by the image file through the controlling processor, which is not shown. The colors are captured by drum 19 according to said patterns. Drums 14 and 19 rotate in mutual contact and the image is transferred to the temporary substrate that has been fed to drum 14. This operation is repeated as many times as is required, generally 3 or 4 times, depending on whether three elementary colors, or three such colors plus black, are used in defining the image. Thereafter, the print substrate, with the image formed thereon, but not yet set and still in a labile state, passes through belt conveyor 20 to the provisional setting area 11, better illustrated in FIG. 3. All the operations described so far and the apparatus means for carrying them out are conventional and well known to persons skilled in the art. As an example of laser printer which comprises all the elements so far described, one may cite CLC-350 by CANON.

Figure 3:
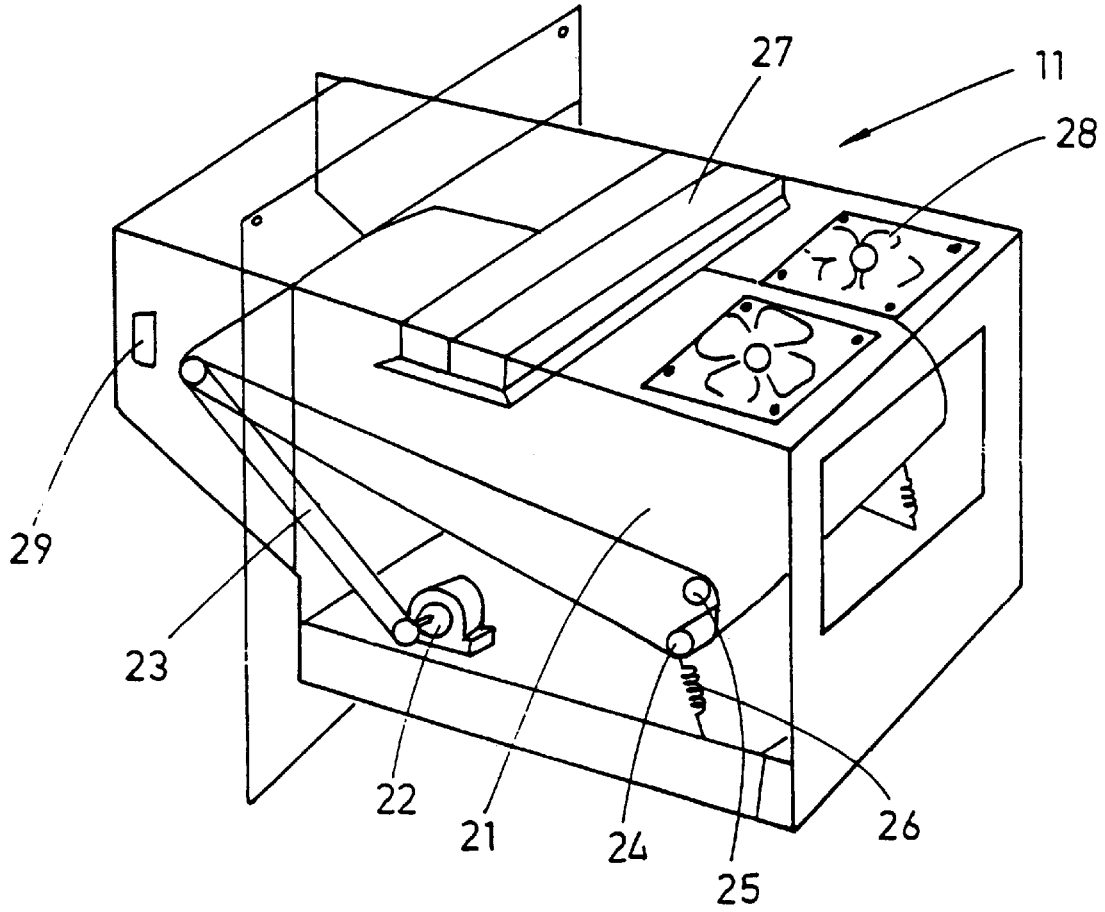
FIG. 3 schematically illustrates the heat-setting section of the apparatus of FIG. 2.

As seen in FIG. 3, the setting area comprises a conveyer belt 21 which transports the temporary substrate with the image, which is driven by a motor 22 through a transmission chain 23, and is guided by rollers 24 and 25, its tension being adjusted by controlling the distance between said rollers by means of a spring 26. A paper sensor 29 signals the arrival of a temporary substrate. Sources of radiant heat, e.g. halogen lamps, or microwave source, 27 effect the provisional heat-setting of the image on the temporary substrate. Fans 28 are conveniently provided to aerate the setting area 11.

The temporary substrates, with the provisionally heat-set image, may be discharged from conveyor belt 21 in any convenient way. The images they carry are then transferred to transparent substrates, these latter are removed, and the transparent substrates are laminated to other components of the document to be produced. This is effected, in the case of as booklet, e.g. by juxtaposing a temporary substrates to the rear face of a transparent substrate and transferring the image to said rear face.

Figure 4:
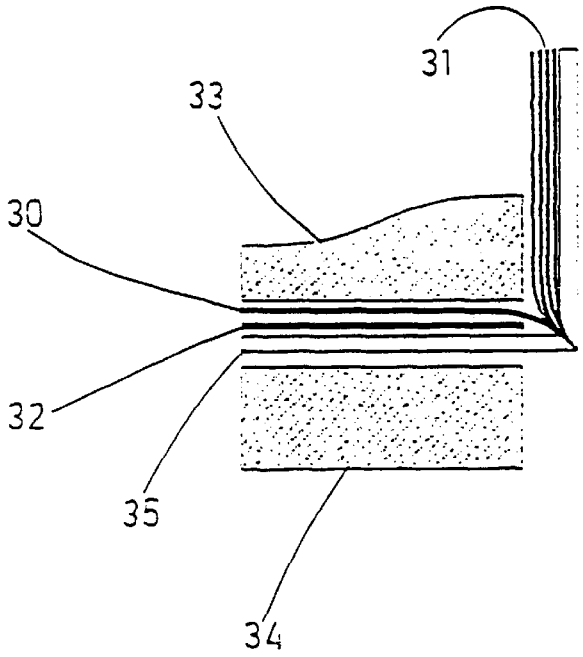
FIG. 4 schematically illustrates the transfer of the image from the temporary to the transparent substrate in an embodiment of the invention, when the final substrate is an internal cover.

FIG. 4 illustrates one way of carrying out this operation, though different ways are readily available to persons skilled in the are. In the embodiment of FIG. 4, transparent substrate 30 is bound in a booklet, e.g. a passport, 31, adjacent to the cover 35 of this latter, the inner face of which is, in this case, the final substrate. The rear face of the transparent substrate 30 faces the cover 35. Temporary substrate 32 is juxtaposed to said rear face, viz., in this case, it is inserted between transparent substrate 30 and cover 35. Plates or rollers 33 and 34 schematically indicate an apparatus for applying pressure, and, if required, moderate heat, to the juxtaposed temporary substrate and transparent substrates, to transfer the image from the former to the latter. The image transfer from the temporary to the transparent substrate is carried out at a temperature from 40° to 180° C.

Figure 5:
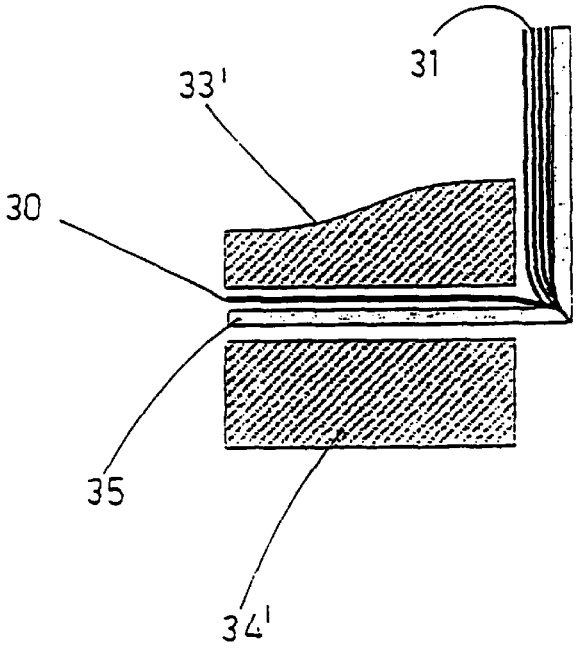
FIG. 5 schematically illustrates the transfer of the image from the transparent to the final substrate in the same embodiment.

Finally, as schematically illustrated in FIG. 5, the temporary substrate having been removed, transparent substrate 30 is juxtaposed to cover 35, which is the final substrate, and pressure and heat are applied thereto by means schematically indicated as plates or rollers 33' and 34', which may be different from those used in the preceding operation, to laminate said two substrates together. The image is now enclosed in the laminate, concurrently bound to both substrates, and is visible from the front face of the laminate, which is the front face of the transparent substrate. If it is desired to mechanize the last operations, various means, easily devised by a person skilled in the art, may be adopted.

Figure 6:
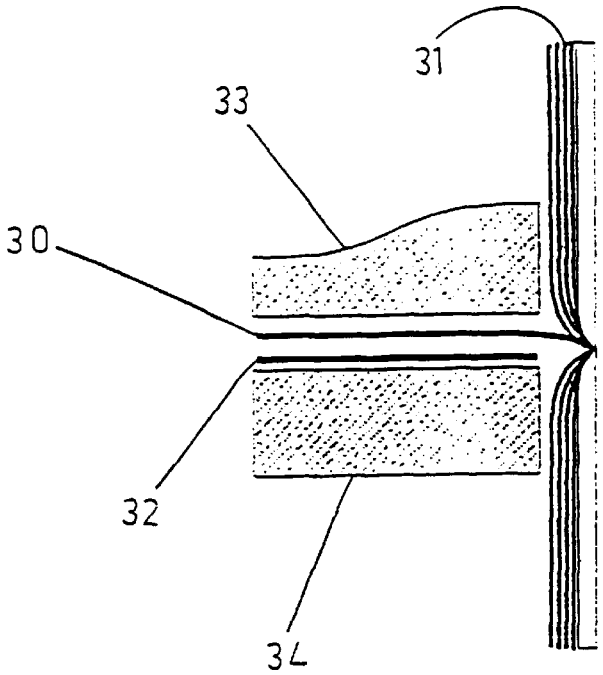
FIG. 6 schematically illustrates the transfer of the image from the temporary to the transparent substrate in another embodiment of the invention, wherein the final substrate is an internal page of a booklet.
Figure 7:
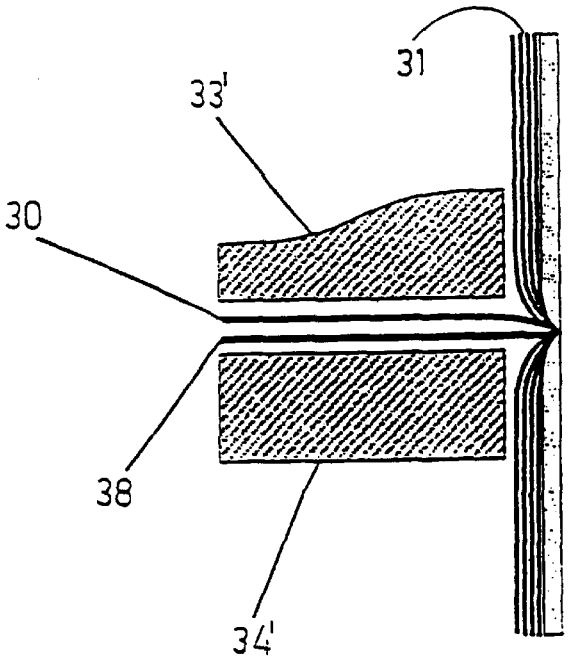
FIG. 7 schematically illustrates the transfer of the picture from the transparent to the final substrate in the embodiment of FIG. 6.

As has been noted hereinbefore, the final substrate need not be part of the cover of a booklet, but could be any intermediate sheet. This case is illustrated in FIGS. 6 and 7, which are analogous to FIGS. 4 and 5, but illustrate an embodiment in which the final substrate is not part of a booklet cover, but is an intermediate sheet of a booklet. In FIG. 6, the image is about to be transferred from the temporary substrate 32 to the transparent substrate 30. In FIG. 7, the transparent substrate 30 is about to be laminated to sheet 38, which, in this particular case, is one of the inner sheets of the booklet.

Figure 8:
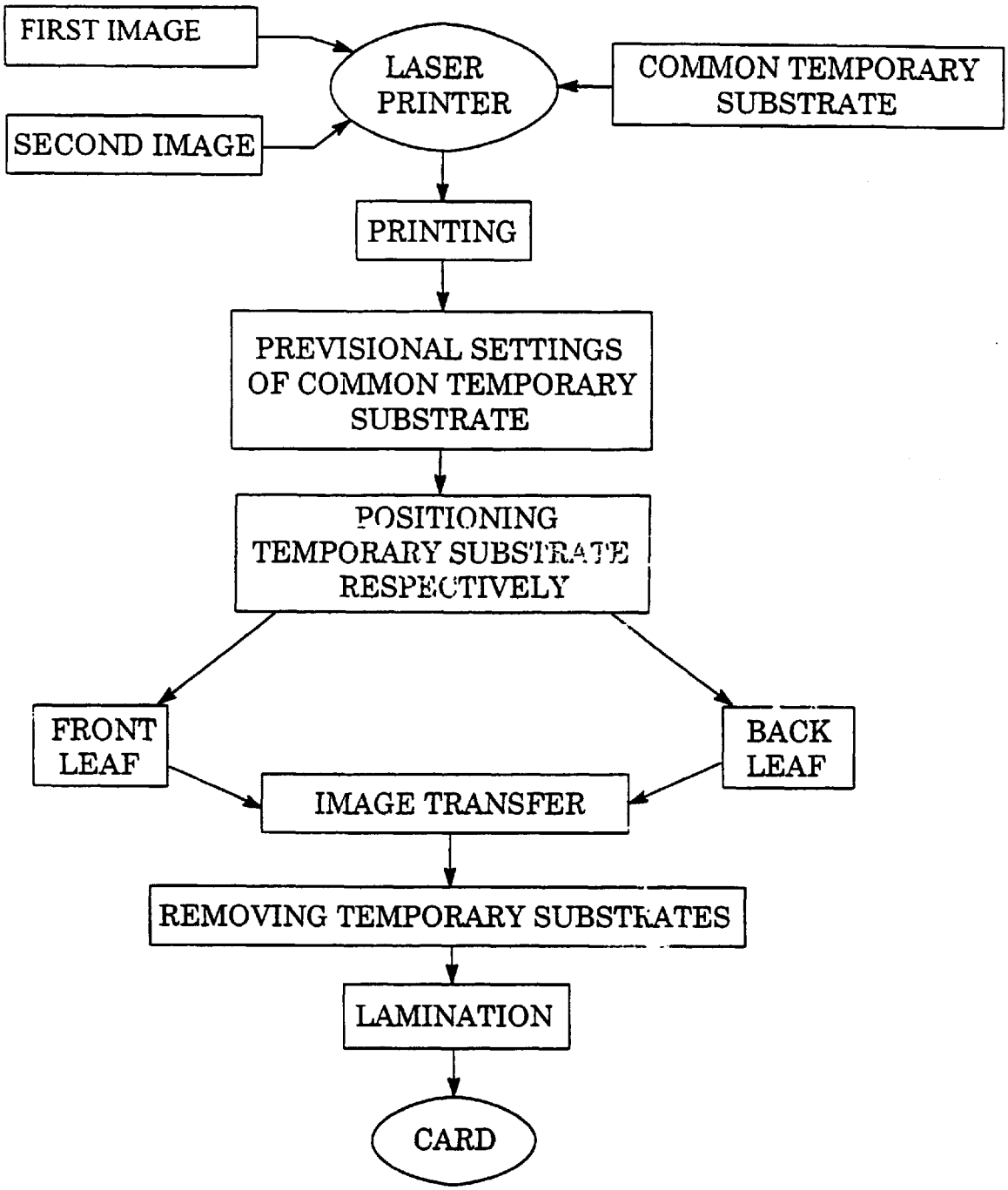
FIG. 8 is a flow diagram schematizing the method according to an embodiment of the invention, wherein the document is in the form of a card.

FIG. 8 is a flow diagram representing an embodiment of the method of the invention, in which a card is prepared that comprises a front and a back leaf, both being transparent and carrying printed images, and an intermediate opaque core.

A card blank, which comprises a transparent front leaf, a transparent back leaf, and an intermediate opaque core, all three components having the desired shape and dimensions and being connected in fixed positioned relationship, is preferably prepared by juxtaposing a first transparent, an opaque and a second transparent sheet, connecting them by lamination along a narrow border strip, and cutting the resulting assembly to the desired size. The aforesaid three sheets are juxtaposed, connected by lamination and optionally cut to size, in a continuous or intermittent manner. The connection by lamination may be effected by pressure and heating, if the transparent sheets are sufficiently thermoplastic. If the card blank to be prepared does not have an intermediate opaque core, the intermediate opaque sheet will be omitted; and if the card blank to be prepared has an opaque back sheet, a single transparent and an opaque sheet will be used. All these variants and operations are carried out by conventional methods, well known to persons skilled in the art.

Figure 9:
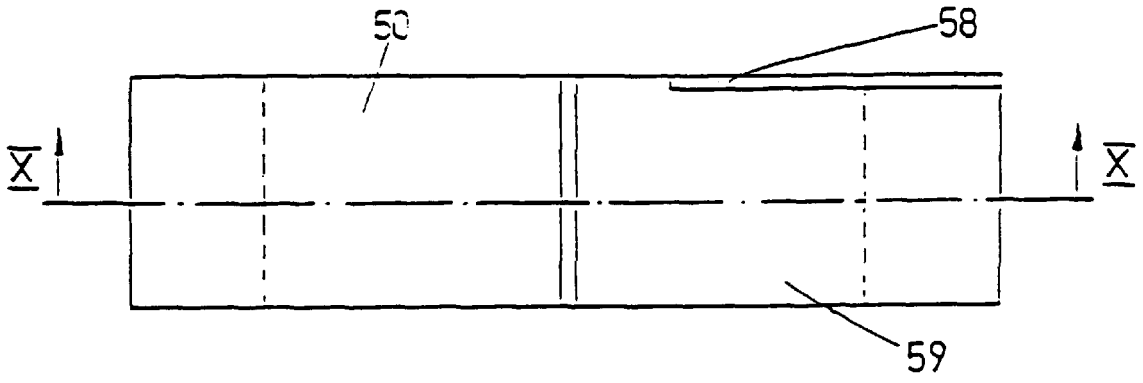
FIGS. 9 and 10 schematically illustrate the preparation of a card blank by conventional means.
Figure 10:
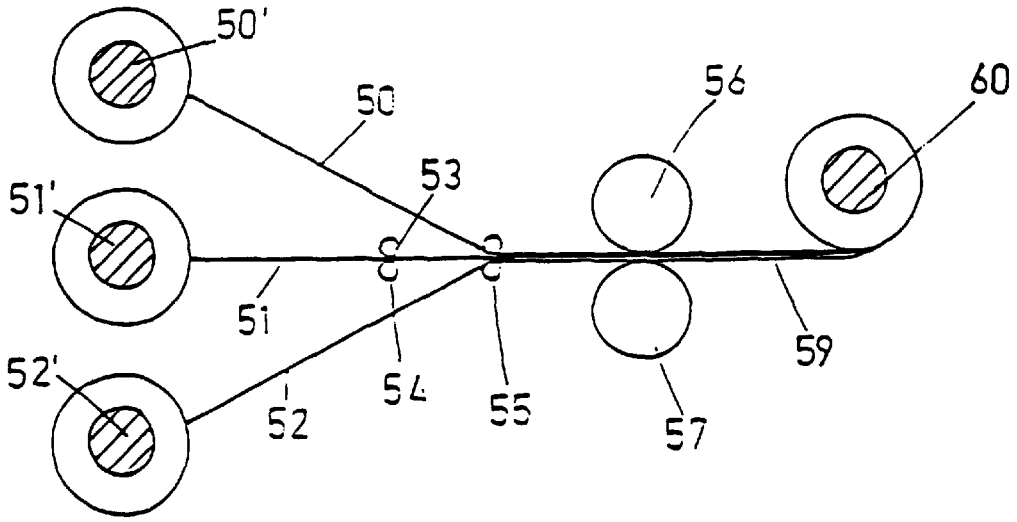

For example, as shown in plan view in FIG. 9) and in cross-section on plane X—X in FIG. 10, a first transparent sheet 50, an intermediate opaque sheet 51 and a second transparent sheet 52 are drawn from respective rolls 50', 51' and 52', and guided by guide rollers 53, 54 and 55 to become juxtaposed. In their juxtaposed condition, they are laminated and joined along a narrow border strip 58, as they advance, by being pressed between heated rollers 56–57, and, finally, the assembly 59 of the said three sheets is drawn by cylinder 60 and wound over it. Thereafter, said assembly 59 is unrolled from cylinder 60 and cut to the desired card blank size by any suitable means. Of course, if the card blank consists of a front and a back leaf only, two sheets, one or both of which are transparent, will be used.

A temporary substrate, carrying the image to be printed on the front leaf, or carrying, side by side, a first image to be printed on the front leaf and a second image to be printed on the back leaf of the card, is prepared by the method steps hereinbefore described.

With reference now to FIG. 8—which, as has been said—represents an embodiment of the invention in which a card is prepared that comprises transparent front and back leaves and an intermediate opaque core - the two image files relative to the two images, no matter how obtained (e.g. from scanning, from composing pictures with data, from a frame grabber, from a video camera or from a buffer memory) are registered in the memory of a general purpose or special computer which controls the laser printer. A single temporary or intermediate substrate, common to both images, is fed to the laser printer for receiving both images. This temporary substrate must have a surface which is considerably less adhesive and/or absorbent to the colors used in the printing than the card front or back leaf, respectively. An example of temporary substrates are papers coated with silicones or Teflon, such as are used for applying to them, for storage and transport, self-adhesive stickers, but not limited, to which papers the silicone coating imparts a smooth, non-adhesive-retaining surface to facilitate the removal of the stickers. The choice of the temporary substrates is influenced by the nature of front and back leaf, since it is required that the capability of the temporary substrate of capturing and/or retaining the printing colors to be used be considerably less than that of the rear face of said front leaf and of the rear face of said back leaf, respectively.

The single or common temporary or intermediate substrate is fed to the laser printer and the image files are printed on distinct areas of the said substrate with various colors in such patterns as to form an image in the conventional way in which the operation is carried out in laser printers. Any type of laser printer can be used for this purpose. After the printing of the images, however, the setting is not carried out as in a conventional laser printer, but is carried out by radiant or IR or microwave heating, thus producing, without the application of pressure, a provisionally heat-set image.

Said provisional setting is only partial and not as complete as the setting normally carried out in laser printers, but is sufficient for the image to be stable enough to permit carrying out the following steps of the process of the invention. Before the provisional setting, on the other hand, the image is quite labile and would not stand the manipulations required by the invention.

The single or common, temporary or intermediate substrate, carrying the two provisionally heat-set images, is folded or separated along a line intermediate between the two images so that the images will remain on two outside faces of the folded substrate, and positioned straddling the core, in such a way that the first image will be located between the core and the front leaf and the second image will be located between the core and the back leaf As a consequence, the outside face of the folded common, temporary substrate that carries the first image will be juxtaposed to the rear face of the front leaf, the outside face of the folded common, temporary substrate that carries the second image will be juxtaposed to the rear face of the back leaf, and the blank, inner faces of the folded common, temporary substrate will be juxtaposed to the two faces of the core. To the juxtaposed common, temporary substrate and front and back leaves, pressure and, if required, moderate heat, are applied to transfer the images to the rear face of the front leaf and the rear face of the back leaf. Once the images have been so transferred, the common, temporary substrate is removed, leaving said images on the front and back leaves. It will be understood that, since the common, temporary substrate carries two images, it may be considered as consisting of a first and a second temporary substrate, each carrying a single image, and joined together along a line intermediate the two images. Obviously, it would be possible, though much less desirable, actually to use two distinct such temporary substrates.

Finally, the font and back leaves and the core are juxtaposed and pressure and, optionally, heat is applied to laminate them together, the images being enclosed between the leaves and the core and visible from the front face of the front leaf and from the front face of the back leaf.

The variations to the above process in the case of different embodiments of the invention, will be obvious to skilled persons. Thus, if no core is present in the card, and in other cases in which no image should appear on the back leaf, there will be no transfer of image to the back leaf, which may be pre-printed, and a temporary substrate carrying a single image will be prepared and used. If the card is to be part of a booklet, either the card blank will be part of the booklet, or the card finally obtained will be bound in the booklet. In the first case, generally (though not necessarily) there will be no core and both leaves will be transparent, there will only be one image carried by temporary substrate, and the operations of transferring the image from the temporary substrate to one of the leaves and laminating the two leaves will be carried out as described, although the leaves are bound in the booklet. If the second case, the card will be prepared as described.

The setting of the images occurs to a substantial degree as a consequence of the transfer from temporary substrates to front and back leaves and is preferably completed in the lamination of both leaves and of the core, if any. The face of each leaf that is to bear print preferably has a non-smooth finish that facilitates the adhesion and the absorption of the coloring matter of the print, and/or may be covered with a thin layer of adhesive matter. It may be made, for example, of polyester, e.g. polyester sheet, such as DuPont's Mylar™ and have the thickness from 10 to 70 $\mu$m. The opposite face is preferably smooth and shiny.

Figure 11:
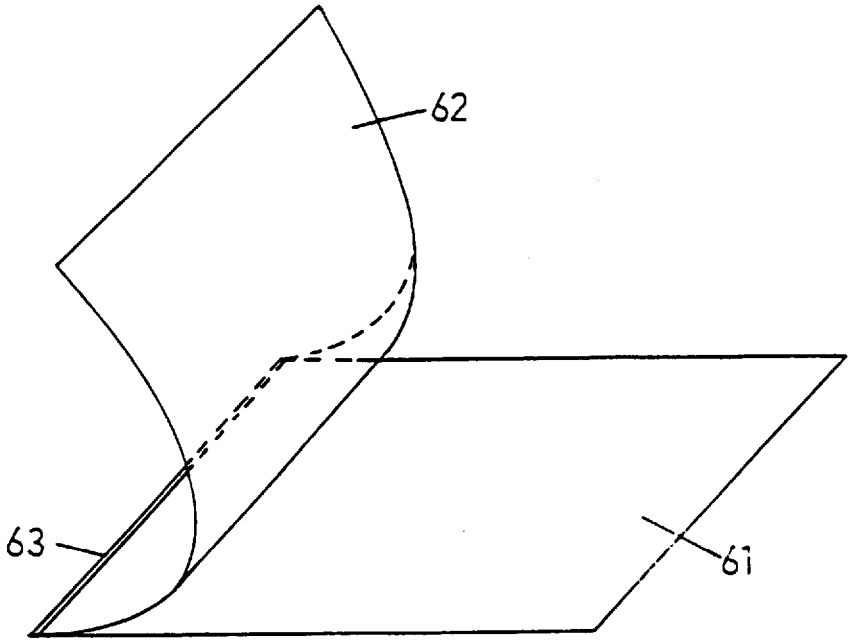
FIG. 11 schematically illustrates a card blank according to an embodiment of the invention.

FIG. 11 schematically illustrates a card blank comprising a back leaf 61 and a transparent front leaf 62, folded away from the back leaf for illustration purposes, both leaves being joined along the edge 63. The back leaf 61 can be transparent or opaque, as desired.

Figure 12:
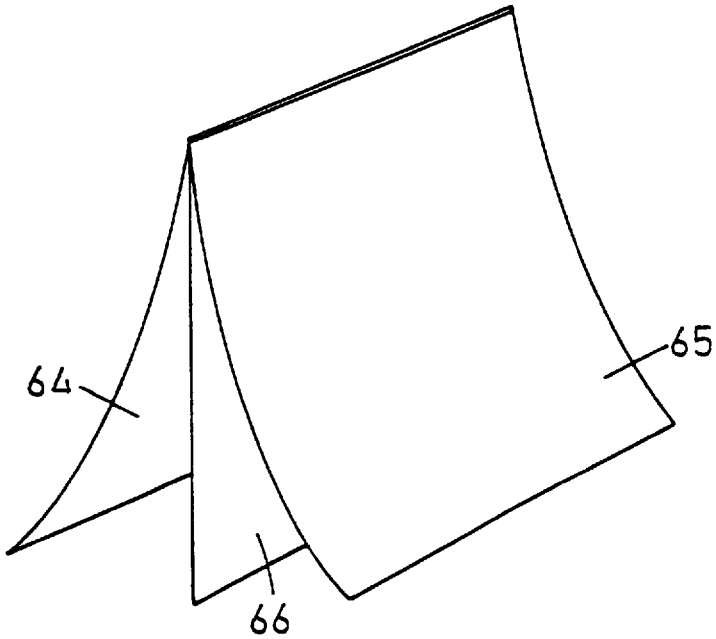
FIG. 12 schematically illustrates a card blank according to another embodiment of the invention.

FIG. 12 schematically illustrates another card blank, comprising a transparent front leaf 64, a transparent back leaf 65 and an opaque core 66.

Figure 13:
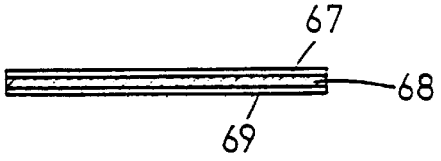
FIG. 13 is a schematic cross-section of a card according to an embodiment of the invention.

FIG. 13 illustrates in cross-section a card which comprises a front leaf 67, a core 68, and a back leaf 69, said three components being laminated together, their thickness being exaggerated in the drawing for illustrative purposes.

Figure 14A:
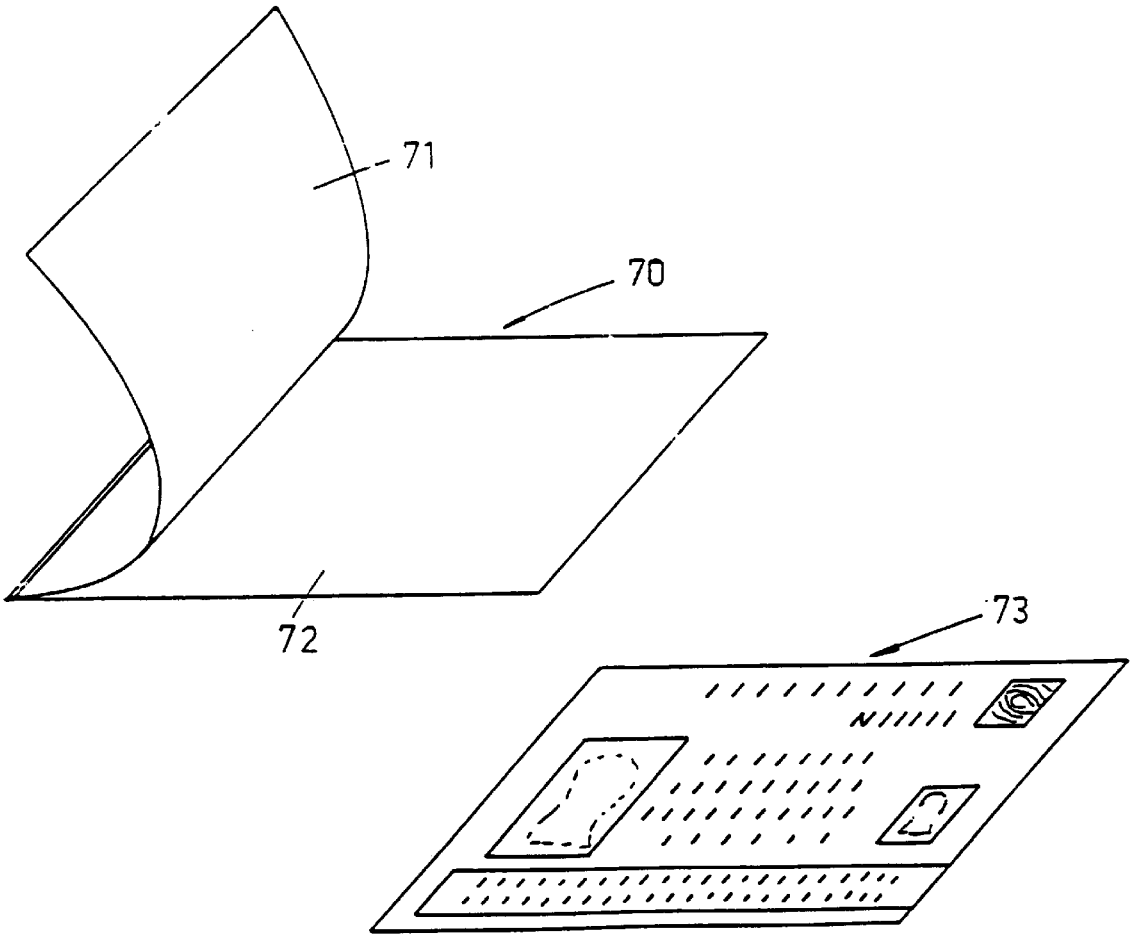
FIGS. 14*a* to 14*e* schematically illustrate the stages of the transfer of the image to the front leaf of a card blank according to an embodiment of the invention.
Figure 14B:
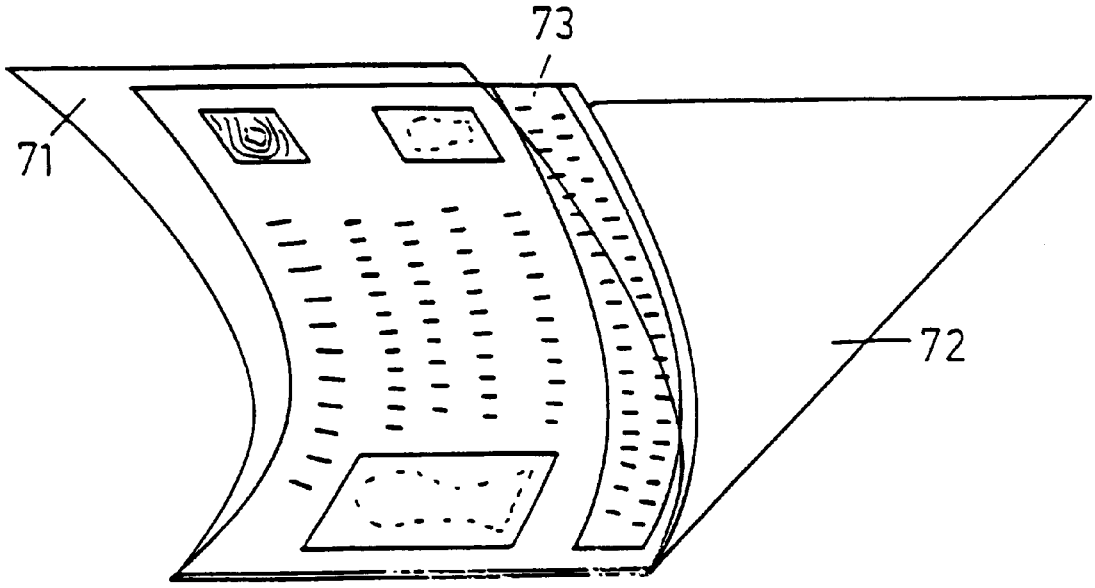
Figure 14C:
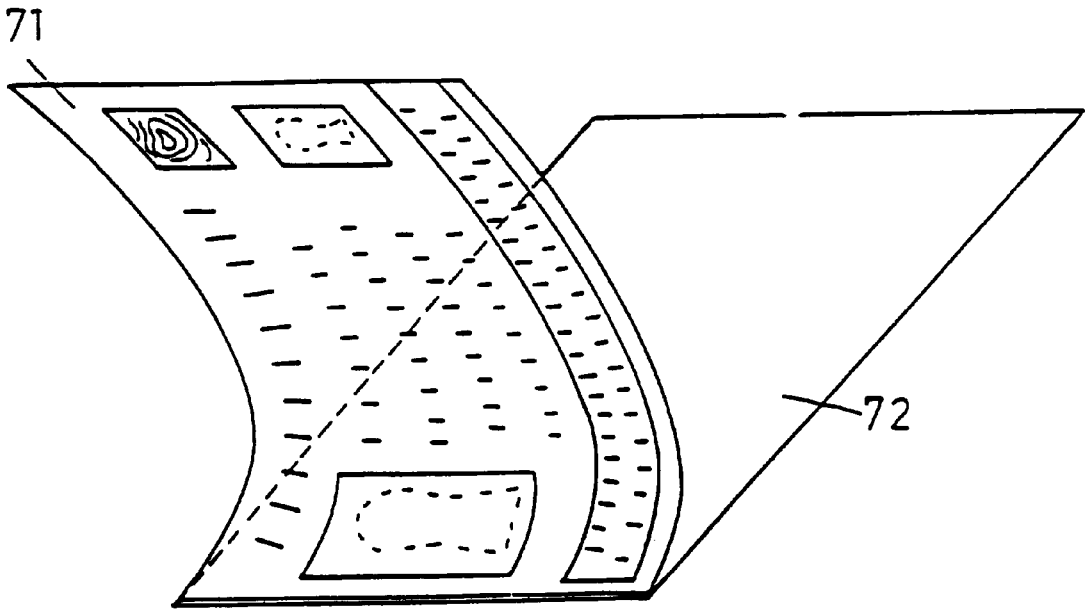
Figure 14D:
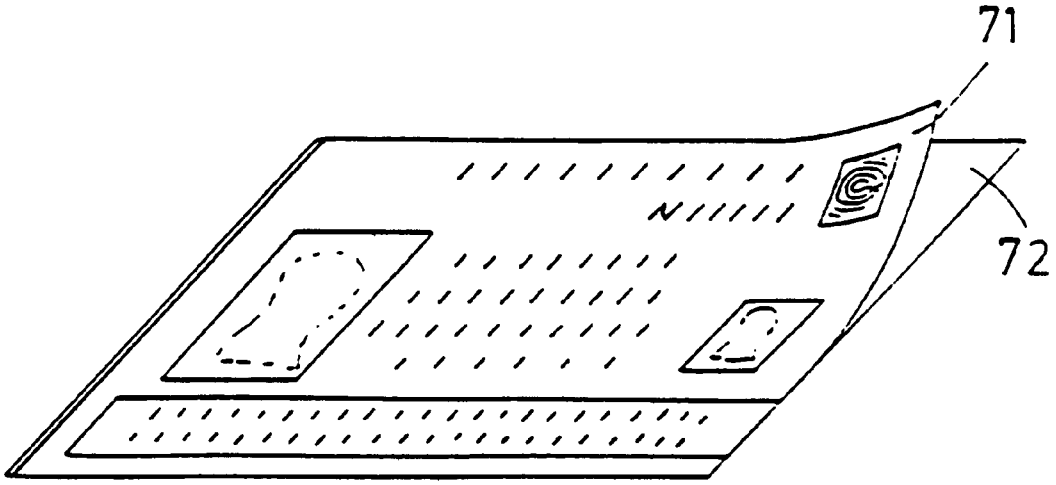
Figure 14E:
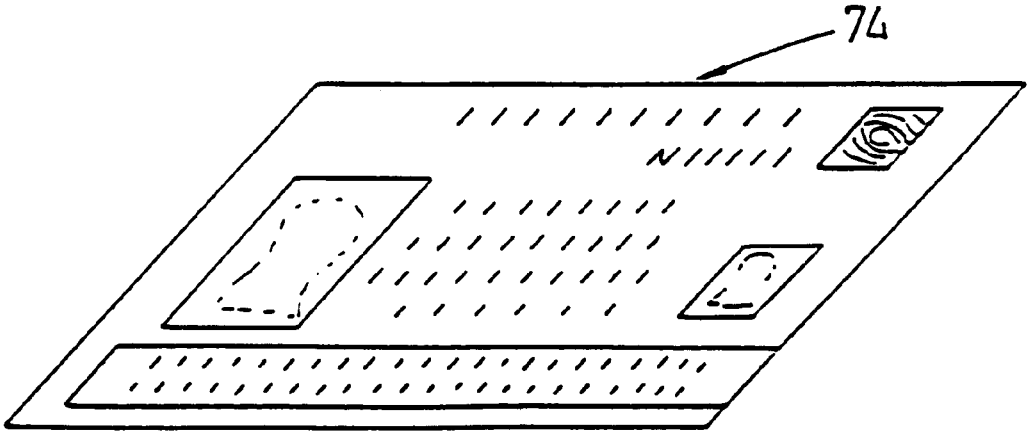

FIGS. 14*a* to 14*e* schematically illustrate the stages of the transfer of the image to the front leaf of a card blank such as illustrated in FIG. 9. In FIG. 14*a*, the card blank, indicated at 70, comprising front leaf 71 and back leaf 72, and a temporary substrate 73 are shown as spaced from one another. In FIG. 14*b*, the temporary substrate 73 is about to be juxtaposed to front leaf 71 of the card blank. FIG. 14*c* illustrates the stage in which the image has been transferred to the rear face of front leaf 71 and the temporary substrate 73 has been removed. Finally, FIG. 14*d* illustrates the stage in which the front and back leaf of the card are loosely juxtaposed, front leaf 71 being shown as lifted at one corner to show that it is not yet laminated to back leaf 72. The final, laminated card 74 is shown in perspective view in FIG. 14*e*.

Figure 15A:
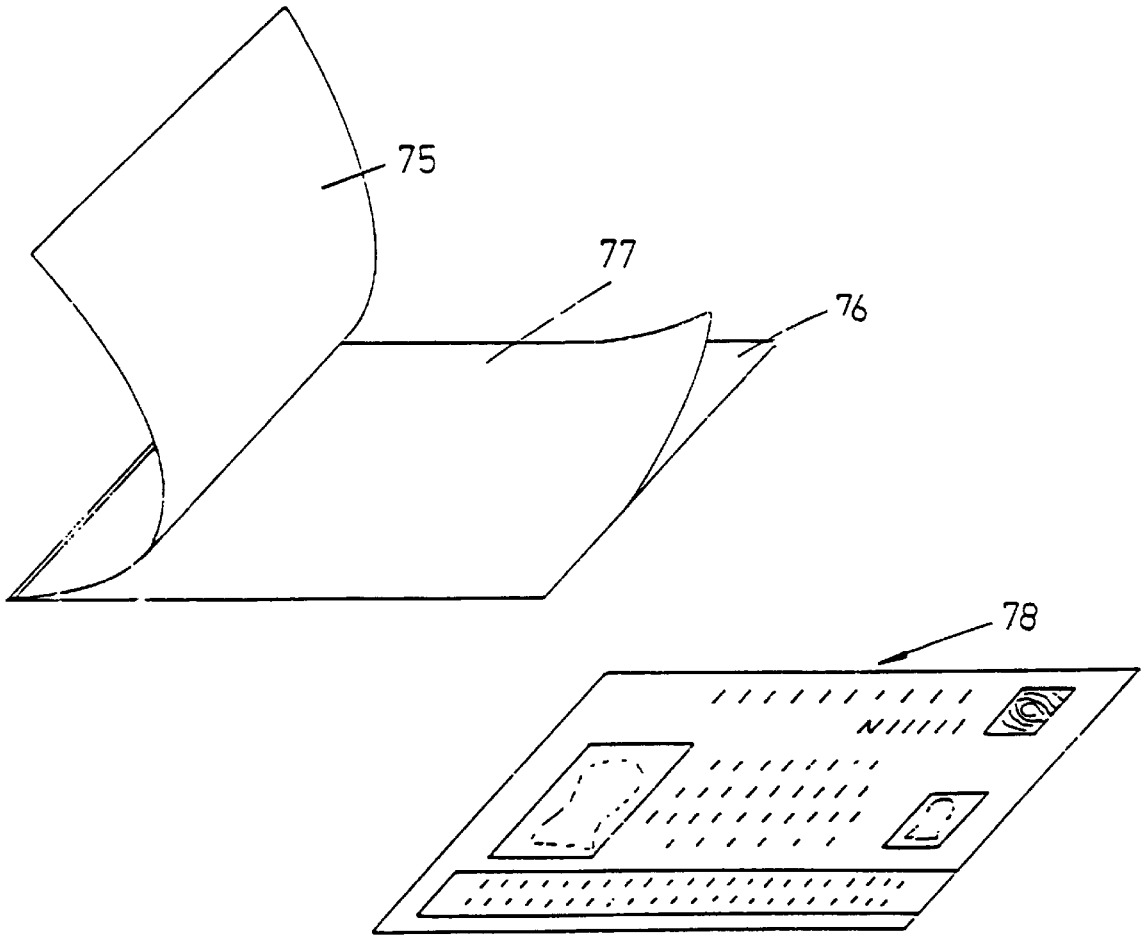
FIGS. 15*a* to 15*e* schematically illustrate the stages of the transfer of the image to the front leaf a card blank according to another embodiment of the invention.
Figure 15B:
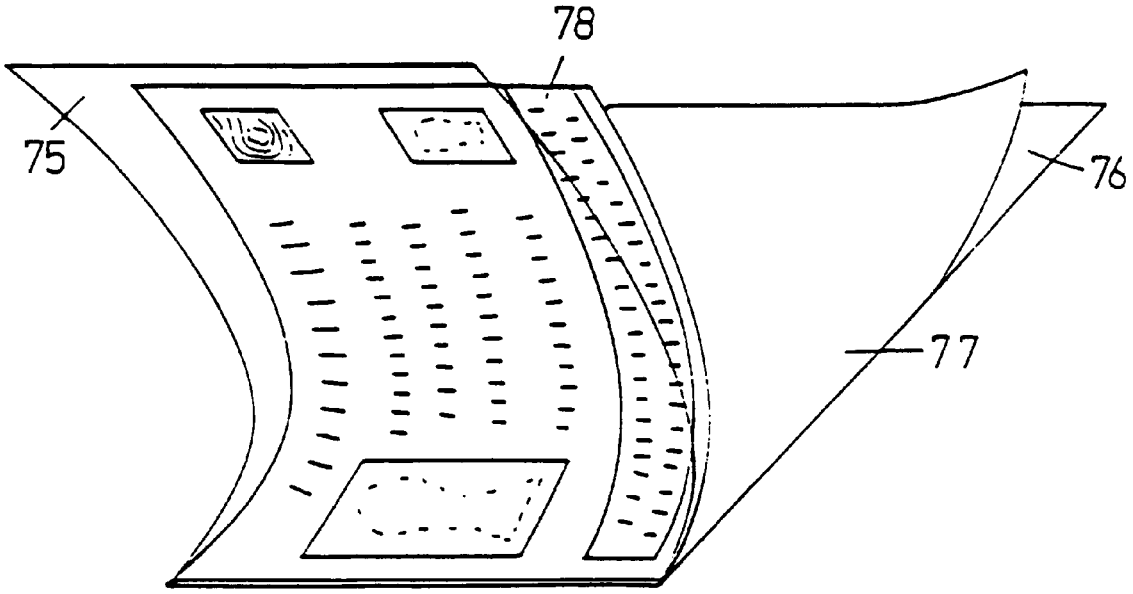
Figure 15C:
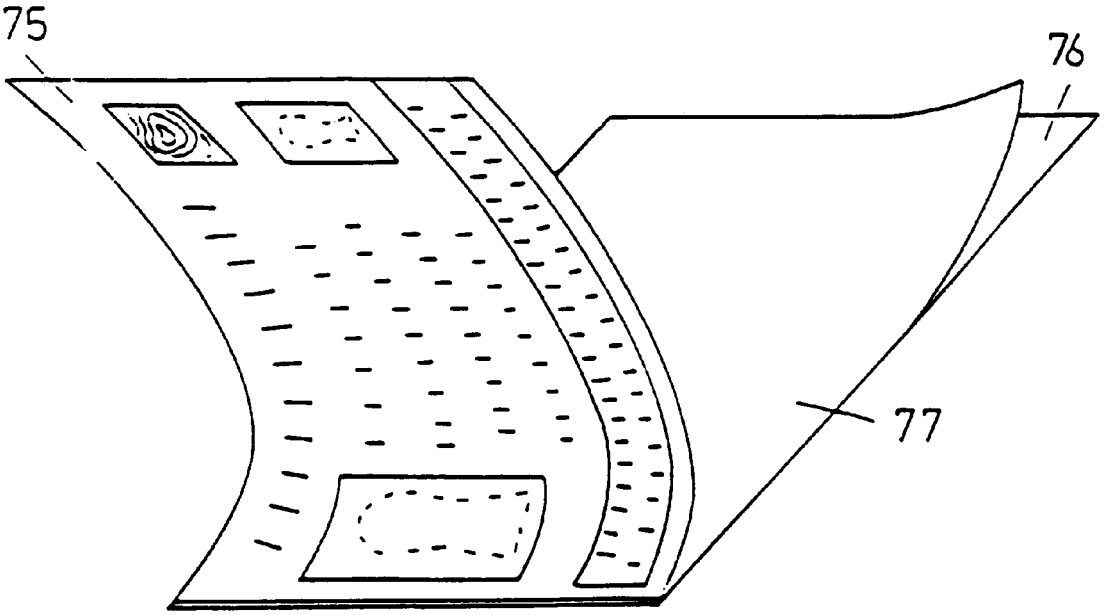
Figure 15D:
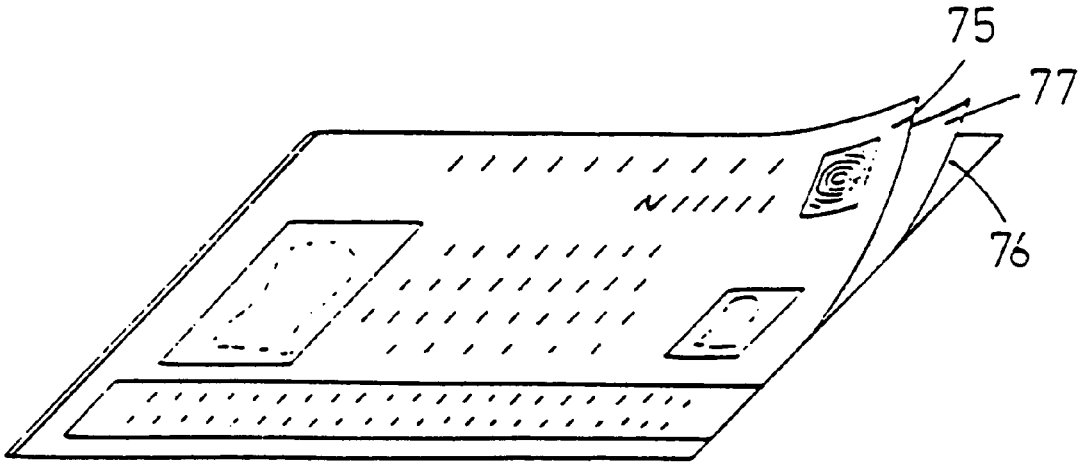
Figure 15E:
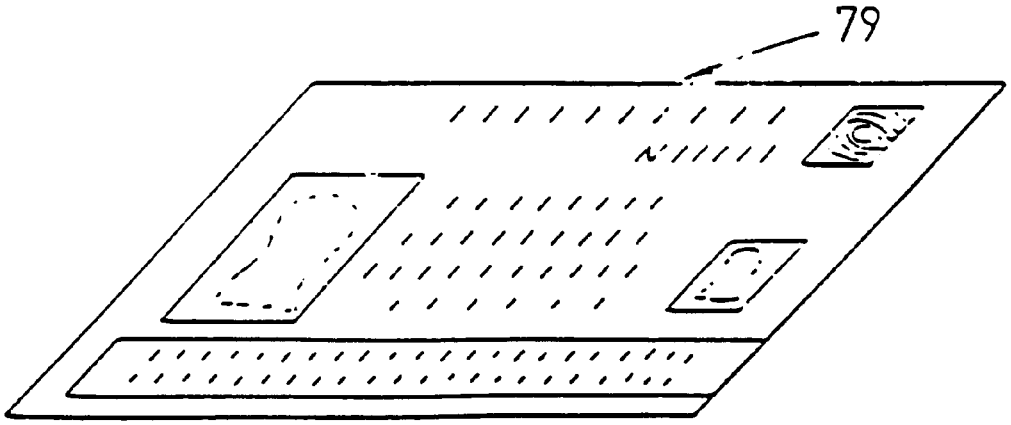

FIGS. 15*a* to 15*e* illustrate the stages of the transfer of the image to the front leaf of a card blank such as illustrated in FIG. 12. They are the same stages illustrated in FIGS. 14*a* to 14*e*, but applied to a card that includes, besides a transparent front leaf 75 and a transparent back leaf 76, an opaque core 77, the temporarily substrate being indicated at 78 and the laminated card produced at 79. In FIGS. 15*b* and 15*c*, the core 77 and the back leaf 78 are shown as separated at a corner, for purposes of illustration. In FIG. 15*d*, the front leaf 75, the core 77 and the back leaf 76 are shown as separated at a corner, for purposes of illustration. If the core is pre-printed, its printer matter will show as background to the image transferred to the front leaf 75, but no such matter is shown in the drawings, in order not to complicate them needlessly. Obviously, the same figures could be construed as illustrating the transfer of an image to the back leaf: it would suffice to consider numeral 75 as designating the back leaf and numeral 76 as designating the front leaf.

Figure 16:
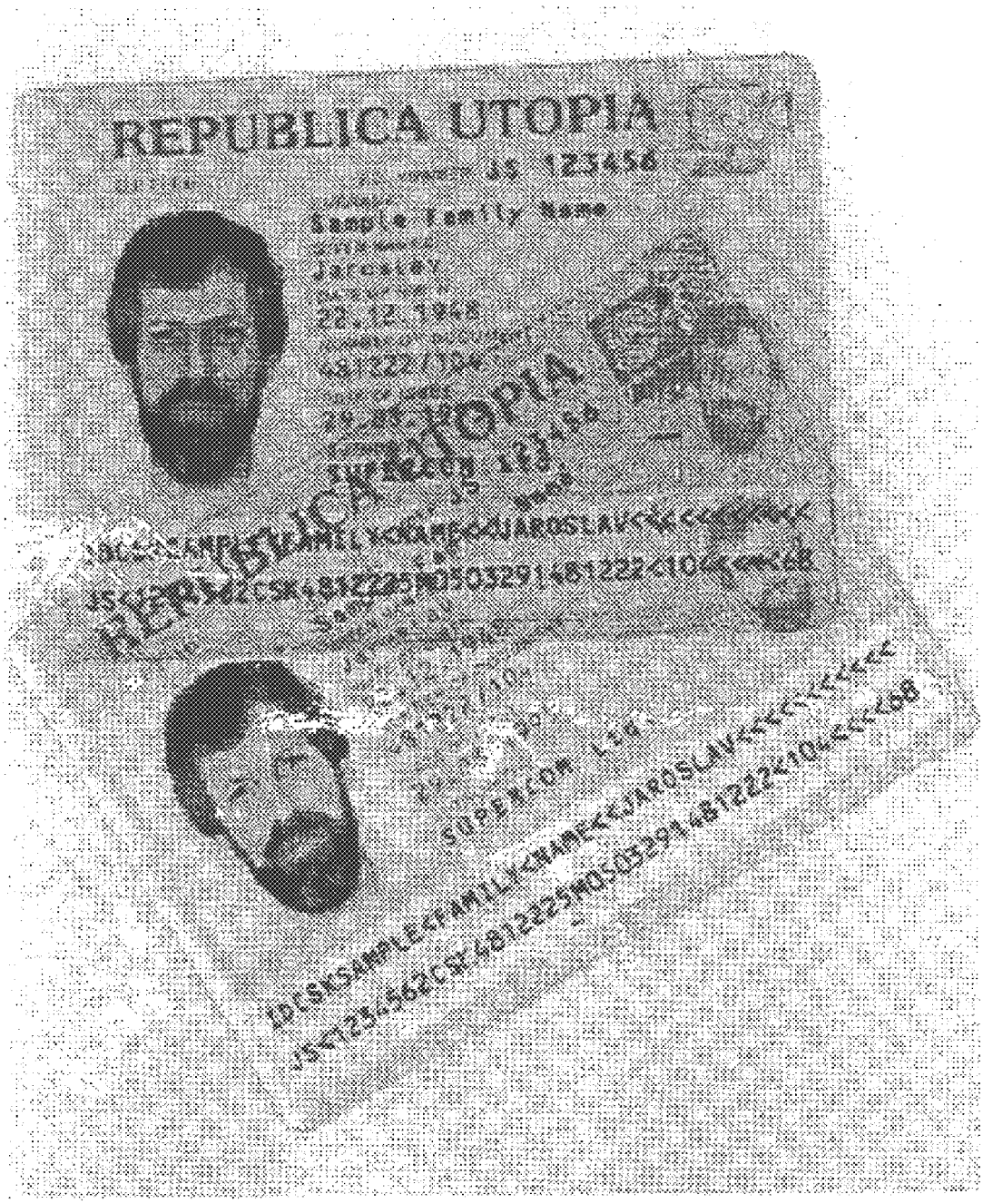
FIG. 16 illustrates two identity cards according to two embodiments of the invention.

FIG. 16 shows two cards according to embodiments of the invention. The bottom card comprises an opaque core, and therefore the photograph and the data carried by it are visible against a white background. The top card consists of a front and a back leaf, both transparent. It is partly superimposed to the other card, to evidence its transparency.

While embodiments of the invention have been described by way of illustration, it will be apparent that the invention may be carried out by persons skilled in the art with many modifications, variations and adaptions, without departing from its spirit or exceeding the scope of the claims.

What is claimed is:

1. Method of making documents by laser printing, which comprises the steps of:

a) defining a subject matter to be printed on the document in the form of an array of digital signals;

b) electrostatically charging a metal cylinder by laser beams controlled by said signals;

c) passing the charged cylinder in the vicinity of a reservoir of coloring matter in powder form, whereby to attract said coloring matter particles to said charged cylinder, and form therein a desired pattern;

d) providing a temporary substrate;

e) passing said temporary substrate into contact with said metal cylinder and depositing thereby said pattern formed by said coloring matter;

f) repeating the aforesaid operations for each desired color to form a multicolor image;

g) provisionally and partially setting said multicolor image by applying heat without applying pressure;

h) providing a transparent substrate having a rear face and a front face;

I) transferring said provisional and partially set image from said temporary substrate to said transparent substrate by applying pressure and, if required, moderate heating, whereby said image is applied to said transparent substrate rear face, and is visible through said transparent substrate from the front face thereof;

j) providing a final substrate;

k) juxtaposing said transparent substrate to said final substrate with the rear face of said transparent substrate in contact with the front face of said final substrate; and l) laminating said transparent substrate to said final substrate.

2. Method according to claim 1, wherein the temporary substrate has a surface which is less adhesive and/or absorbent for the coloring matters than that of the transparent substrate.

3. The method according to claim 1, wherein the document is in booklet form and comprises a final substrate that is intended to carry the image, and wherein the transparent substrate is laminated to the final substrate:

hot or cold laminating said transparent substrate in contact with said final substrate, permanently to bond them, whereby said image becomes enclosed in the laminate and visible through said transparent substrate as if printed on said final substrate.

4. Method according to claim 3, wherein the document in booklet form comprises a cover and intermediate sheets, and the final substrate is part of the cover or an intermediate sheet of a booklet.

5. Method according to claim 3, wherein the transparent substrate is part of the booklet of which the final substrate is a part.

6. Method according to claim 3, wherein the transparent substrate is a separate sheet.

7. Method according to claim 1, wherein the document is a card, further comprising providing a card blank having a front and a back leaf of predetermined shape and dimensions, at least the front leaf being transparent and the back leaf being transparent or opaque, said two leaves being connected in fixed position relationship, and wherein said front leaf constitutes the transparent substrate and said back leaf constitutes the final substrate.

8. Method according to claim 7, wherein the front leaf and the back leaf are connected in fixed positioned relationship by being joined along a very narrow strip on one side thereof.

9. Method according to claim 7, wherein the card blank comprises an opaque core, the front and back leaves both being transparent.

10. Method according to claim 9 further comprising preparing a second temporary substrate carrying a second image and transferring said second image to the rear face of the transparent back leaf, whereby it is visible, in normal form, through said transparent back leaf from the front face thereof.

11. Method according to claim 10, wherein the two temporary substrates are physically joined to constitute a common temporary substrate, which method comprises concurrently printing two images on distinct areas of said substrate, folding said substrate along a line intermediate between said two images, straddling the folded substrate over the core of the card blank in such a way that one image is juxtaposed to the rear face of the front leaf and the other image is juxtaposed to the rear face of the back leaf, and transferring said images respectively to the rear face of the front leaf and to the rear face of the back leaf.

12. Method according to claim 9, wherein the opaque core is pre-printed on at least one of its faces.

13. Method according to claim 7, wherein the front and the back leaf are transparent and are bound in a booklet.

14. Method according to claim 7, wherein the card blank is provided by juxtaposing at least two sheets, at least the front sheet being transparent, connecting them along a narrow border strip, and cutting the resulting assembly to the desired shapes and dimensions.

15. Method according to claim 7, wherein the front leaf is made of polyester sheet.

16. Method according to claim 7, wherein the back leaf is made of polyester sheet.

17. Method according to claim 7, wherein the transparent leaf or leaves have thickness from 10 to 70 $\mu$m.

18. Method according to claim 7, wherein the laminating temperature is from 40° to 180° C.

19. Method according to claim 1, wherein a setting of the image occurs as a consequence of a conditions of lamination.

20. Method according to claim 1, comprising partially setting the image in its transfer from the temporary substrate to the transparent substrate.

21. Method according to claim 1, wherein the transparent substrate has a front face that is smooth, while the rear face has a non-smooth finish that facilitates adhesion and absorption of the coloring matter of the image.

22. Method according to claim 1, wherein the transparent substrate has a rear face that is covered with a thin layer of adhesive matter.

23. Method according to claim 1, wherein the transparent substrate is a polyester sheet.

24. Method according to claim 1, wherein the transparent substrate has a thickness from 10 to 70 $\mu$m.

25. Method according to claim 1, wherein the laminating temperature is from 40° to 180° C.

26. Method according to claim 1, wherein the image transfer from the temporary to the transparent substrate is carried out at a temperature from 40° to 180° C.

27. Method according to claim 1, wherein the lamination is carried out with the help of an adhesive layer applied to the transparent substrate, over the image, after transferring the image to said transparent substrate.

28. Method according to claim 1, wherein the temporary substrate is made of paper coated with silicone.

29. Apparatus for making a laser printed document comprising an opaque sheet, which comprises:

A) A laser printer comprising:

1) a metal cylinder
2) a laser beam generator for generating laser beams and causing them to impinge on said cylinder in a pattern controlled by an array of digital signals, to charge said cylinder, electrostatically according to said pattern;
3) multiple reservoirs of coloring matter providing the colors desired for a multicolor image;
4) means for slowly passing said cylinder in the vicinity of the reservoirs of coloring matter, whereby to form a pattern on the surface of said cylinder;
5) means for passing temporary printing substrate into contact with said cylinder, whereby to form thereon an image;
6) a setting section comprising heating means for temporary setting said image without application of pressure;

B) an apparatus for transferring the temporary set image from said temporary substrate onto a transparent substrate; and C) an apparatus for laminating said transparent substrate to said opaque sheet.

30. Apparatus according to claim 29, wherein the laminating apparatus comprises means for applying pressure and means for applying heat.

31. Apparatus according to claim 30, wherein the means for applying pressure are rollers or pressure plates.

32. Apparatus according to claim 29, wherein the apparatus for transferring the image from the temporary substrate onto a transparent substrate comprises means for applying pressure and, if required, heat to the juxtaposed substrates.

33. Apparatus according to claim 32, wherein the means for applying pressure are rollers or pressure plates.

34. Apparatus according to claim 29, wherein the heat-setting means are radiant heating means or microwave means.

35. Document, in particular card, characterized in that it comprises at least a front and a back leaf, laminated together, the front leaf having an image printed on its rear face and visible through said front leaf from its front face, which further comprises an opaque core sandwiched between said front and back leaves and laminated therewith.

36. Document according to claim 35, wherein the core is pre-printed on one or both of the faces thereof.

37. Document according to claim 35, wherein the rear face of the back leaf of the document also bears a printed image.

* * * * *